United States Patent [19]

Toivonen

[11] 4,390,778

[45] Jun. 28, 1983

[54] CALCULATOR FOR DETERMINING OPTIMUM TONE REPRODUCTION

[76] Inventor: Thomas N. Toivonen, 173-03 Fairchild Ave., Flushing, N.Y. 11358

[21] Appl. No.: 309,488

[22] Filed: Oct. 7, 1981

[51] Int. Cl.[3] ..... G06C 3/00

[52] U.S. Cl. ..... 235/89 R; 235/70 R

[58] Field of Search ..... 235/69, 70 R, 70 B, 235/89 R

[56] References Cited

U.S. PATENT DOCUMENTS

| | | | |
|---|---|---|---|
| 2,634,912 | 4/1953 | Davey | 235/70 B |
| 2,746,682 | 5/1956 | Zak | 235/70 R |
| 3,719,806 | 3/1973 | Davidson | 235/70 R X |
| 3,999,041 | 12/1976 | Scofield | 235/89 R |

*Primary Examiner*—Benjamin R. Fuller

[57] ABSTRACT

A mid-tone calculator for determining density reproduction to maximize color reproduction in a lithograph tone process. The calculator includes a base having a longitudinal guideway therein, an original density scale thereon and a density compression scale thereon. A lower slide is reciprocally shiftable in the guideway. An upper transparent slide is reciprocally shiftable in the guideway and overlies the lower slide with the slides being shiftable in the guideway with respect to one another. One of the slides has a high density indicator and the other of the slides has a low density indicator thereon. One of the slides has a plurality of tone reference number curves and the other of the slides has a tone intersect line thereon. A transparent cursor is longitudinally shiftably mounted on the base, overlies the slides and is shiftable with respect thereto, and has a half tone placement indicator thereon. Shifting of the slides to produce alignment of the high density indicator with a predetermined high density reading and the low density indicator with a predetermined low density reading on the original density scale will cause the tone intersect line to intersect the tone reference number curves. Thereafter, shifting of the cursor to a chosen point of intersection of the tone intersect line with a tone reference curve will bring the half tone placement indicator into alignment with a reading on the density compression scale to indicate a density for optimum half tone position.

16 Claims, 6 Drawing Figures

20
22
32
60
58
34
44
40
48
46
42
38
30
56
50
54
52
36
64
62
24
68
70
66
74
72
26
80
28
76
78
84
86
82

CALCULATOR FOR DETERMINING OPTIMUM TONE REPRODUCTION

BACKGROUND OF THE INVENTION

Color is highly subjective yet it can be submitted to scientific measurement. We all use our eyes which, coupled with our brain, prove to be the most efficient color comparison computer. Human eyes as a computer, are self-lubricating and structurally efficient. They consume mineral energy, are maintained at a constant temperature and react to all properties of color. However, eyes are not infallible. Each person sees color differently and there is no precise prismatic color memory. Accordingly, color is subjective. Human eyes measure all characteristics of color at once but scientific measurements supplement the eye. These systems are concerned with only one property of color at any given measurement.

Color separation processes have never been standardized and probably never will be because of the need of customized separations, either to compensate for the different printing processes or to emphasize an effect in a supplied original of a particular product. Over the years, many masking and separation systems have been developed, some are simple and others are very elaborate. Naturally the more elaborate systems involve more elaborate processes. Additionally, the systems become more expensive as additional labor and material is employed. Even with the more complex systems, there is no single system that will provide the optimum tone reproduction.

Technology has advanced to a point where it is possible to produce separations in a fraction of the time with a high degree of quality and flexibility. With electronic scanning, the color separation process has become more and more automated and technology continues to increase. But even with the technology now available, the basis of the difficulty concerning all separators, conventional or electronically operated, is still the determination of optimum tone reproduction. Percent tone reproduction is very important.

Color correction is important but is still secondary to good gray balance. Color correction may be influenced by the inclination of energy absorption of the color separation filters, the spectral range of the photo multipliers and the position of the logarithmic circuits. These type of parameters control the addition and subtraction of components and exponents. However, certain color hues can be corrected mechanically later in the design of the product as long as the picture content and resolution has the shape and tonal reproduction.

Spectral energy output is a method of classification of originals and a determination of their tone reproduction to maximize reproduction efficiency. This objectively based method would enable a scanner operator to select a tone reproduction curve from such a system for that class of an original. The system could be expected to efficiently produce pleasing color reproduction from a wide range of transparencies without human intervention. Studies to find the optimum tone reproduction curve have involved the making of a large number of reproductions which varied in their tonal content. Experiments have found that tone reproduction curves are potentially more accurate because they are based on the picture contact rather than on a gray scale and basic standard aim points. Utilizing statistical sampling of the tones of the picture, and curves derived from the originals can be used to objectively classify the picture by type, processing and contrast.

Data for generating the tone reproduction curves can be obtained by measuring the density of the originals and the density of the gray scale scanned along with the reproduction. The gray scale is used as a stand-in for the picture because it is more convenient to measure. Important information to the overall concept of reproduction includes the computation of the characteristic of the densitometer, press and the mode of modular transfer functions. Classification was considered by comparing and ranking originals by their dye-sets to define their frequency of occurrence for any range of tones. Since contrast can range in the highlight, midtone and shadows of an original, it is useful to numerically measure each of these areas. That type of information can be derived by a slight variation of the Jones-type diagram. This charge diagram was used to divide the tone reproduction curves into four quadrants,* using the curves of the reproduction and the original. This criteria enables a computation to distinguish the curve slopes and, hence, the image classification without human intervention. Therefore, the cumulative frequency of the quadrants show a tabulation into a percent density reference valve corresponding to the highlight, midtone and shadow. The overall curve shapes show the slopes to be lateral linear. Holding the highlight point of the picture slope of the curve maintains the color cast and signifies the magnitude. The corresponding tone encountered at the lower end depicts the picture saturation. This difference multiplied by a percent density reference number signifies the density for the midtone placement, hence, the optimum tone reproduction. In this manner, a picture can be thought of as consisting of a large number of single areas having different tones and lightness. For example, in high key pictures, a large percentage of the tonal areas are light while the largest percentage of tones in a low key picture are dark. With this in mind, originals can be objectively classified not only by their dye-sets but also by contrast and type. The optimum tone reproduction curve is the relationship between what can be considered more negative or more positive with respect to the gray line. This distribution is derived directly from the tonal gradation range content of each dye layer of the original.

*1. DENSITY RANGE OF THE ORIGINAL
2. DENSITY RANGE OF COMPRESSION
3. PERCENT DOT REPRODUCTION OF THE DENSITY SLOPE
4. NEUTRAL INK BALANCE OF THE TONE REPRODUCTION

The theory of spectral energy output is not only based on the linear characteristic curves and logarithmic balance needed for printing ink but also takes into consideration the spectral energy dye-set of the original.

The spectral energy output is derived from the original with the use of a three-filter spectral densitometer. This derives information from the original on the basis of its dye-set absorption and provides a numerical determination to coordinate the position of the midtone gradation automatically. The red, green and blue filter readings are required to define the dye-sets of the original in order to determine the curve slope to render a balanced neutral output.

Different color materials are designed to meet different objectives and have different dye-sets for different jobs. There are colors which may appear the same to the eye but which have different spectral energy distribution outputs. In this theory, the densitometer measures an exact match for an exactly defined color. The tone reference number value corresponds to the general shape of the tone reproduction curve. Technically, each printing ink pigment should absorb ⅓ of the visible spectrum. However, both the yellow and magenta pigments absorb in the blue portion of the spectrum and thus, the pigments are not ideal. By this mutual absorption, a precise tone reproduction relationship exists between the yellow, magenta and cyan process inks in order to render a neutral gray at the output.

A neutral balance product can be derived from the original's own energy output at any given tone reference number for a shop's standard. A reproduction can require a color shift either because of a bad cast in the original or because of a particularly bad ink or press condition or even to custom tailor a desired special result.

The output of the product can be modified intentionally by using two or more different tone reference numbers either in the direction of dark or light and the resultant curve will either be convex or concave.

In taking into consideration the spectrum energy outputs of the original it should be kept in mind that the visible white light spectrum absorption is 400–700 nanometers, that is the light reflected or transmitted as seen by the eyes. Light is energy wave motion starting with red as the least energy and progressively more energy through orange, yellow, green, blue, indigo, and violet. The colors having the greatest absorption are those with the least energy output.

There is a geometrical logarithmic progression, that is the density of the common logarithm in relation to the reciprocal of transmittance. It should also be kept in mind that there is a linear relationship involved in that the reproduction output values are directly proportional to the original output densities.

There are colors which may appear the same to the eye but which have different spectrum energy distribution outputs. With the theory of spectral energy output, the densitometer measures a density match for an exactly defined color. For the color balance, a dye-set target is exposed and developed in such a way that the colors would equal the optimum of its own dye-set nature in magnitude and saturation and are used to calibrate the color correction.

It would certainly be advantageous to develop a quick and efficient calculator device and method to take advantage of the theory of spectral energy output as set forth above.

Calculators have been used in many environments to take advantage of a given arrangement for theoretical facts to simplify and assist in quickly and efficiently applying the theory to a given practical approach in a particular environment.

For example, U.S. Pat. No. 3,719,806 shows a slide rule type device used in calculating halftone screen exposures. A plurality of reciprocally movable slide members with appropriate linear scales, a base, a cursor, and predetermined curves on the structure for alignment with the linear scales are part of the design.

Similar calculating devices are used in a variety of different environments as can be seen in U.S. Pat. Nos. 1,881,165; 2,434,306; 2,569,454; 2,746,682; 2,793,808; 2,960,267; 3,024,977; 3,135,465; 3,162,363; 3,522,655; 3,572,583; 3,652,831; 4,071,189; 4,146,173; 4,179,610; and 4,186,297. However none of these references shows a structure which is adaptable for use as a mid-tone calculator for determining optimum density reproduction in a lithographic tone process.

SUMMARY OF THE INVENTION

With the above background in mind, it is among the primary objectives of the present invention to provide a mid-tone calculator and method for taking advantage of the theoretical factors involved in the theory of spectral energy output.

It is among the objectives of the invention to provide a mid-tone calculator for determining optimum density reproduction in a lithographic tone process where the calculator is a range calculator used to determine the placement of the midtone value. The calculator is designed to help the conventional and electronic scanner operator to predetermine the contrast characteristics of the original and the mid-tone placement to maximize reproduction efficiency.

The calculator of the present invention is simple in construction and design and can be quickly and efficiently operated to assist the user in determining optimum tone reproduction for a prevailing shop standard.

It is an objective in the invention to provide a mid-tone calculator employing a base having a longitudinal guideway therein and with an original density scale along with a density compression scale thereon. A lower slide is reciprocally shiftable in the guideway and an upper transparent slide is reciprocally shiftable in the guideway as well and overlies the lower slide with the slides being shiftable in the guideway with respect to one another. One of the slides has a high density indicator and the other of the slides has a low density indicator. One of the slides has a plurality of tone reference number curves and the other of the slides has a tone intersect line. A transparent cursor is longitudinally shiftably mounted on the base, overlies the slides and is shiftable with respect thereto, and has a halftone placement indicator thereon. Shifting of the slides to produce alignment of the high density indicator with a predetermined high density reading and the low density indicator with a predetermined low density reading on the original density scale will cause the tone intersect line to intersect the tone reference number curves. Thereafter, shifting of the cursor to a chosen point of intersection of the tone intersect line with a tone reference curve will bring the halftone placement indicator into alignment with a reading on the density compression scale to indicate a density for optimum halftone position.

In summary, the present invention takes advantage of the relationship of certain statistical data. A plurality of tone reference number curves and a tone intersect line are placed in overlying relationship with one another and are shiftable with respect to one another. An original density scale and a density compression scale are arranged in parallel and are spaced from one another in fixed position with respect to one another. The tone intersect line and the plurality of tone reference number curves are positioned between the scales and are shiftable with respect thereto. A high density indicator and a low density indicator are aligned with the original density scale and each of the indicators is fixed with respect to one of the plurality of tone reference number curves and the tone intersect line and movable with respect to the other. A halftone placement indicator is positioned in overlying shiftable relationship with respect to the tone reference number curves and the tone intersect line and is shiftable with respect to the density compression scale in position to indicate readings thereon. With this arrangement, when the high density indicator and the low density indicator are positioned in predetermined alignment with appropriate respective high density and low density readings on the original density scale, the tone intersect line will intersect the tone reference number curves. Thereafter, shifting of the halftone placement indicator into alignment with a chosen point of intersection of the tone intersect line and a tone reference curve will permit the halftone placement indicator to indicate a reading on the density compression scale indicating a density for optimum halftone position.

With the above objectives among others in mind, reference is made to the attached drawings.

BRIEF DESCRIPTIONS OF THE DRAWINGS

In The Drawings

DETAILED DESCRIPTION

Figure 1:
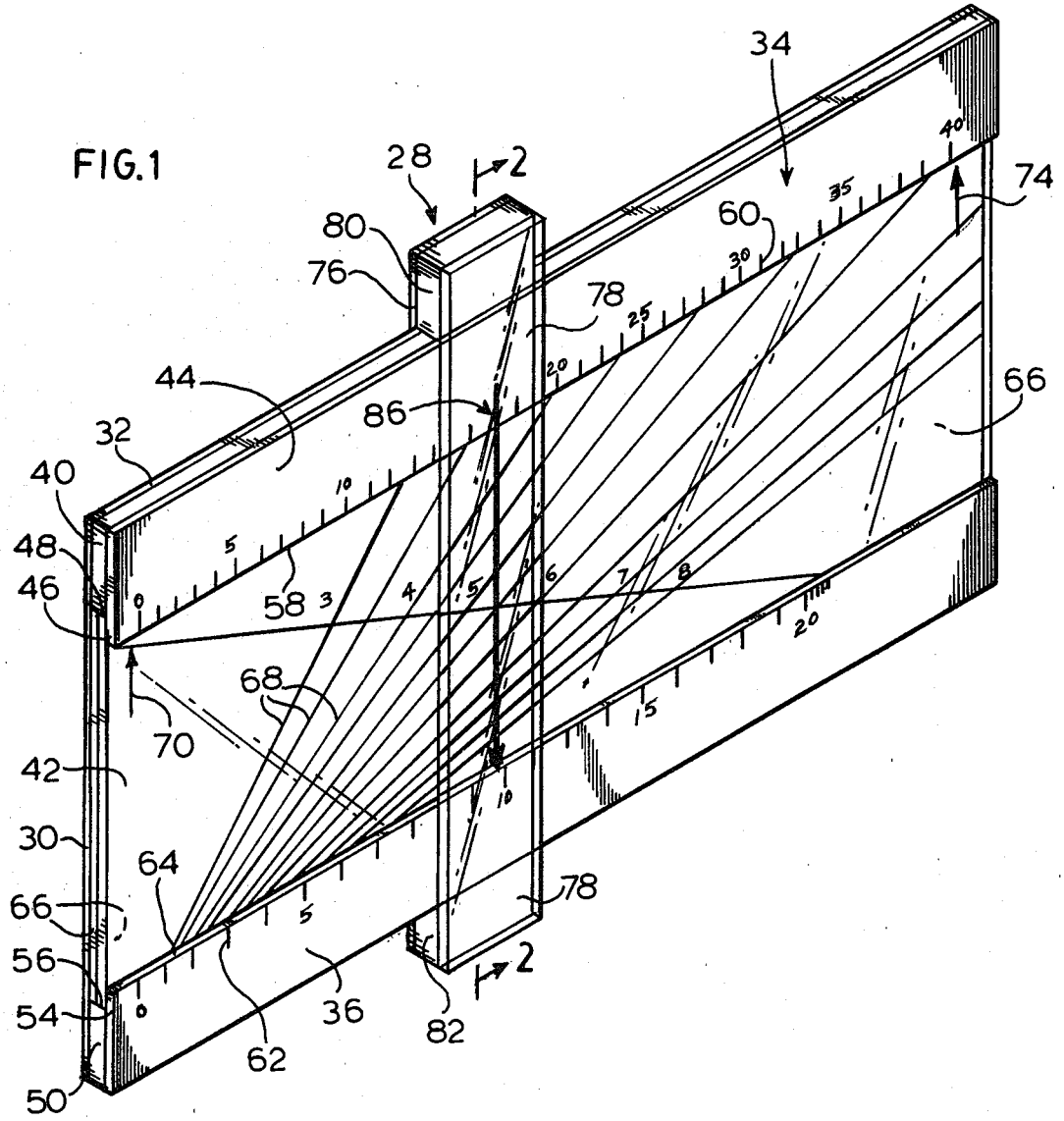
FIG. 1 is a perspective view of the mid-tone calculator.
Figure 2:
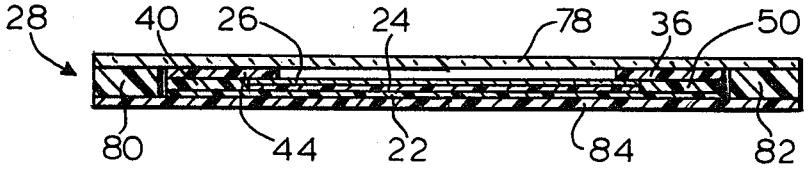
FIG. 2 is a sectional end view thereof taken along the plane of line 2—2 of FIG. 1.
Figure 3:
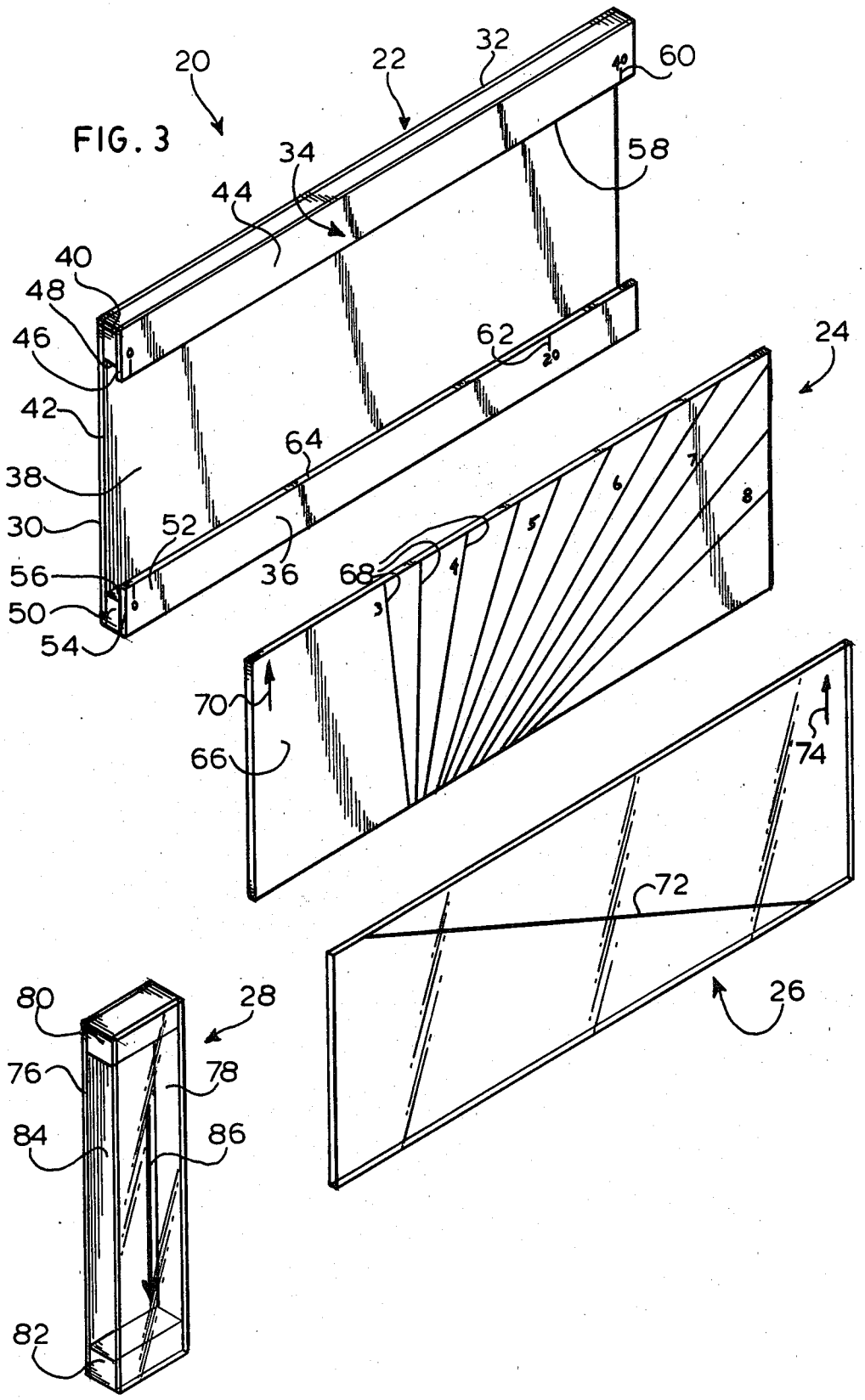
FIG. 3 is an exploded perspective view thereof.

The details of structure of calculator 20 can be best seen in FIGS. 1-3 of the drawings. Calculator 20 is formed of four basic components, a base 22, a lower slide 24, an upper slide 26, and a cursor 28.

Base 22 is substantially rectangular in configuration including a base wall 30 which is provided with a flat outer surface 32 and a pair of opposing longitudinal projecting inner wall portions 34 and 36. Portions 34 and 36 are elongated in configuration and are spaced from one another to form an exposed inner longitudinal recess 38 therebetween. Portion 34 extends the length of base 22 and has a narrow diameter portion 40 captured between the inner face 42 of base wall 30 and the adjacent face of a wider diameter exposed portion 44. The overlapping and extending portion of exposed portion 44 forms a flange 46 and thereby provides a longitudinal recess 48 acting as a guideway the length of the base 22.

Opposing wall portion 36 is similarly formed with a first narrower diameter portion 50 captured between the base wall 30 and the inner surface of the wider diameter exposed portion 52. Flange 54 on portion 52 produces a recess 56 extending the length of the base which also acts as a guideway cooperating with guideway 48 in the base to permit longitudinal reciprocation of members mounted in recesses 48 and 56.

On the exposed face of portion 44 adjacent to its longitudinal edge 58 next to recess 38 is an original density scale 60.

A density compression scale 62 is on the exposed surface of portion 36 adjacent to edge 64 thereof which bounds opening 38. Thus, scales 60 and 62 are longitudinal scales on base 22 and are fixed and parallel with respect to one another. Recesses 48 and 56 are open at both ends to permit the reciprocal shifting of slides 24 and 26 therein. For this purpose, slides 24 and 26 are of lesser diameter when positioned in overlying relationship to one another than the width of recesses 48 and 46 thereby permitting their reciprocation therein and relative reciprocation with respect to one another.

Slide 24 is rectangular in configuration and on its exposed face 66 has a plurality of tone reference number curves 68. Also positioned on the exposed face of slide 24 is a high density indicator 70. The high density indicator 70 is positioned transverse to the longitudinal axis of the slide and accordingly to the recess 48 when the slide is positioned in the base. High density indicator 70 is positioned on slide 24 adjacent to original density scale 60 when the slide is positioned in the base.

Slide 26 is also rectangular in configuration and on its exposed face has a tone intersecting line 72. Also on its exposed face is a low density indicator 74 adjacent to the edge of the slide 26 which is closest to the original density scale 60 when the slide 26 is mounted in the base. Slide 26 is transparent so that when it is mounted in the base in overlying position with respect to slide 24, the tone reference number curves on slide 24 can be observed through the exposed face of slide 26 and the points of intersection between the tone intersect line 72 and the tone reference number curves 68 can be observed.

The final element of the structure is cursor 28. Cursor 28 is also rectangular in configuration that is of considerable narrower width than the base and the two slides. It includes a narrow bottom plate 76 and a similarly sized top plate 78. The plates are spaced from one another by a pair of end bars 80 and 82 so that a through recess 84 is formed in the cursor 28. Recess 84 is large enough so that the base 22 and the slides 24 and 26 can be reciprocated therethrough and accordingly the purser can slide along the arrangement of the base and slides in both directions. The exposed plate 78 of cursor 28 is transparent so that the intersecting tone intersect line 72 and tone reference curves 68 can be observed therethrough. Also, a halftone placement indicator 86 is positioned thereon transverse to the longitudinal axis of the calculator 20 so that it overlies the intersecting tone reference curves 68 and tone intersect line 72 of the slides. The indicator 86 points to the adjacent density compression scale 62 longitudinally arranged on the base when the cursor 28 is positioned on the base.

Alternative arrangements of the indicia can be readily envisioned. For example, the location of the high density and low density indicators can be interchanged as well as the locations of the tone reference number curves and the tone intersect line. The versatility of the system is readily apparent and the indicia can be modified as long as the relationship between the various indicators and indicia is maintained.

Figure 4:
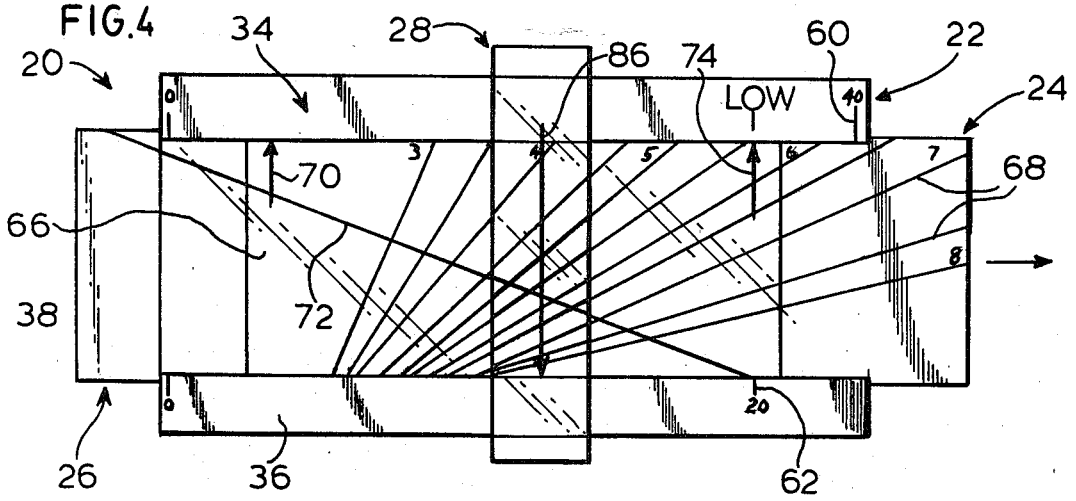
FIG. 4 is a schematic elevation view thereof showing the first step of use of the calculator.

In use, the densities of the original are measured in a conventional manner such as by the use of a densitometer and the highest high of the filter readings is noted along with the lowest reading of each filter. With these readings in mind, as shown in FIG. 4, calculator 20 is utilized by first aligning the high density indicator 70 on the lower slide 24 to a point on the original density scale 60 corresponding to the highest high reading on the densitometer. This is accomplished by sliding lower slide 24 with respect to the base 22 to the right in the drawing along the original density scale 60 on base 22.

Figure 5:
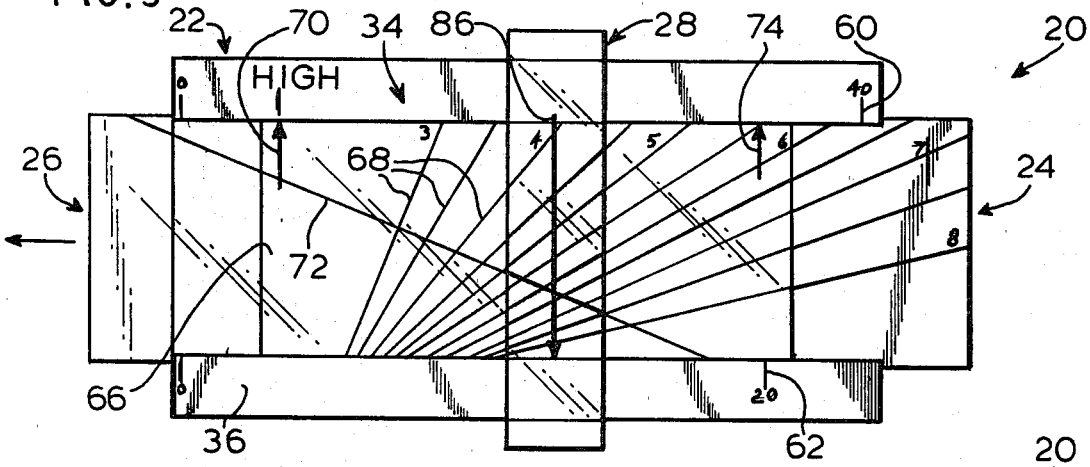
FIG. 5 is a schematic elevation view of the calculator showing the second step of use.

Thereafter, as shown in FIG. 5, the low density indicator 74 on the upper slide 26 is aligned with original density scale 60 on the base to indicate a reading corresponding to the low reading for one of the colors recording on the densitometer. This is accomplished by sliding upper slide 26 to the left with respect to the base as shown in the drawing against the original density scale 60 on the base 22.

Figure 6:
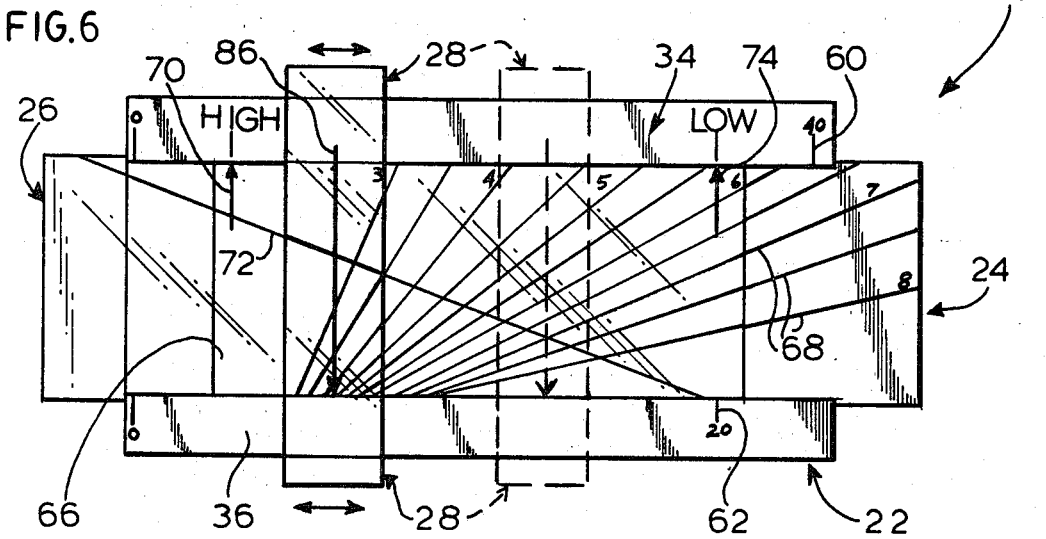
FIG. 6 is a schematic elevation view showing the third and final step of use.

An appropriate tone density line is then chosen and, as shown in FIG. 6, cursor 28 is moved relative to the base and slides to a point where the tone intersect line 72 on the upper slide 26 intersects the appropriate tone reference number curve 68 on the lower slide 24 as shown in phantom. At that point, the halftone placement indicator 86 will point to a reading on the compressed density scale 62 on the base corresponding to a density for optimum half tone position.

Retaining the lower slide 24 in position to retain the high density indicator 70 at the highest high density reading, upper slide 26 can be shifted to bring the low density indicator 74 into alignment with an appropriate reading on scale 60 corresponding to the low density reading for each of the colors. As each low density reading is set, the cursor 28 can be shifted to the new intersect point between the tone intersect line 72 and the chosen curve 68 so that calculator 86 will designate the proper optimum halftone position on the compressed density scale 62 for each successive color.

It has been found that the best optimum reference curve for given shop standards is chosen between the range of 6.0 to 7.5.

The optimum halftone position on the compressed density scale refers to the position on the gray scale. The gray scale is used as a stand-in for the picture because it is easier to match percent tone to density reproduction than by using the picture.

A successful example of use of the calculator in accordance with the above procedures can be described in the following manner. A Kodachrome 35 mm code 5032 film was utilized and appropriate densitometer recordings were made. The highest highlight recorded was 0.25 density. The lowest recorded readings for each color were 3.20 for black, 3.40 for cyan, 3.85 for magenta and 3.30 for yellow. The picture range was an imbalanced input. A tone reference number of 7.0 was used and the mid-tone density was calculated to be 1.20 for black, 1.28 for cyan, 1.44 for magenta and 1.25 for yellow. Accordingly, the optimum position of mid-tone placement on the gray scale in percent tone was 25% for black, at density 1.20, 65% for cyan, at density 1.28, 50% for magenta, at density 1.44, and 50% for yellow, at density 1.25. In the case of continuous tone reproduction for gravure or offset, the placement at density of the gray scale would be expressed as density of reproduction. An example, 65% for cyan at density 1.28 would be the same as 0.95 density at 1.28 of the gray scale for continuous tone. The result was optimum reproduction neutral balance output.

The spectral energy output is derived from the original with the use of a 3-filter spectral densitometer. The status A red, green and blue filter readings are required to define the dye-sets of the original. This is done in order to measure the characteristics of the color and record the range of each dye layer, that is the picture highlight and shadow. The highlight depicts the picture magnitude and the picture black and color shadow depicts the picture saturation. The mid-tone placement constitutes the characteristic drawing of the individual tone reproduction and the neutral gray balance.

The original density scale 60 on the depicted embodiment has a range of 4.00 and the density compression scale 62 has a density range of 2.00. The difference that exist between these two scales is equal to approximately a 0.60 density shift in log. In measurement, the original density scale has 20 sub-density points per every 10 units of opacity. The density compression scale has 12 sub-density points per every 10 points of original opacity. In every 10 density of the original, there is 0.06 density increments in the compression scale. Each tone reference number of the tone reference scales is equal to a given percentage of the total tone reproduction from highlight.

Because of variables which arise during the mode of transfer functions (press, paper, ink, contacting of film, plate making, etc.) dot values have the tendency to change during the manufacture of a product. This tendency of dot change in high-key pictures would appear as sharpness of values and the less of highlight detail and separation while in low-key pictures, the tendency would be toward dot gain. This result appears as a more weighty and darker reproduction with a loss of shadow detail and separation. So in keeping with the theory of spectral energy output, the portion of the program as related to the mid-tone calculator known as the mid-tone reference curve values have been adjusted above and below the gray line. This is to compensate for the dot value change. But the dot size reproduction (positive or negative scanning) no longer corresponds to the working film but to the positive optical print of the final product (50 percent reproduction for 50 percent dot ink on paper). This percentage plus the log shift between the original and the density compression scale is what comprises the placement of the mid-tone indicator. It should also be noted that the theory of spectral energy output as applied to the mid-tone calculator is for range calibration for original dye-sets as a warped color space.

The calculator is also designed to compensate for reciprocity failure for the different film emulsion speeds and chemical machine processing. Because of the various types of application for the mid-tone reference calculator such as electronic scanning, conventional screening or continuous tones, it may become desirable to change the alignment of the mid-tone reference curves for the difference variety of film emulsion speeds and their application of chemical machine processing.

This alignment for the mutual dependence for film and processing can be achieved on the lower slide by holding the left side pivot point and moving the right side end in the up or down direction so that the mid-tone placement from a preceeding test scan is in alignment with the halftone placement indicator at value where it crosses the mid-tone reference intersect line at the point where the selected tone reference curve number scale intersects the points of reproduction in question. It should be kept in mind that the procedure for reciprocity and the program change for the variables of mode of transfer functions should not be confused as these are two different procedures. The reciprocity procedure preceeds any mode of transfer function change.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A mid-tone calculator for determining optimum tone reproduction to maximize color reproduction comprising; a base having a longitudinal guideway therein and an original density scale and a density compression scale thereon, a lower slide reciprocally shiftable in the guideway, an upper transparent slide reciprocally shiftable in the guideway and overlying the lower slide and the upper and lower slides being shiftable in the guideway with respect to one another, one of the upper and lower slides having a high density indicator and the other of the upper and lower slides having a low density indicator, one of the upper and lower slides having a plurality of tone reference number of curves and the other of the upper and lower slides having a tone intersect line, a transparent cursor longitudinally shiftably mounted on the base, overlying the upper and lower slides and shiftable with respect thereto, and having a half tone placement indicator thereon, and the base, lower slide, upper slide, and cursor being sequentially shiftable with respect to one another so that shifting of the upper and lower slides to produce alignment of the high density indicator with a predetermined high density reading and the low density indicator with a predetermined low density reading on the original density scale will cause the tone intersect line to intersect the tone reference number curves and thereafter shifting of the cursor to a chosen point of intersection of the tone intersect line with a tone reference curve will bring the half tone placement indicator into alignment with a reading on the density compression scale to indicate a density for optimum half tone position.

2. The invention in accordance with claim 1 wherein the guideway is formed with two opposing longitudinal spaced edges with the original density scale positioned along one longitudinal edge of the guideway and the density compression scale positioned along the other longitudinal edge of the guideway.

3. The invention in accordance with claim 1 wherein the lower slide contains the high density indicator and a plurality of tone reference curves and the upper slide contains the low density indicator and the tone intersect line.

4. The invention in accordance with claim 3 wherein the high density indicator and the low density indicator are transverse lines with respect to the longitudinal guideway and the half tone placement indicator is a line transverse to the longitudinal guideway.

5. The invention in accordance with claim 1 wherein the longitudinal guideway is formed by forming a longitudinal rectangular opening in one face of the base and a recess in each of the opposing longitudinal edges of the base adjacent to the longitudinal opening to form a pair of longitudinal recesses in which the upper and lower slides are slidably mounted, the cursor being rectangular in configuration and having a central aperture therethrough in which the base is slidably mounted to permit relative shifting between the cursor and the base.

6. The invention in accordance with claim 5 wherein the base and upper and lower slides are rectangular in configuration.

7. The invention in accordance with claim 1 wherein the calculator is used for determining density reproduction to maximize color reproduction in a lithographic tone process.

8. The invention in accordance with claim 1 wherein the density indicated on the density compression scale by the half tone placement indicator is for density midtone position on the gray scale.

9. A method for determining optimum tone reproduction ot maximize color reproduction by use of a midtone calculator comprising positioning an original density scale and density compression scale on a base having a longitudinal guideway therein, shiftably mounting a lower slide and an upper transparent slide in the guideway with the upper slide overlying the lower slide and the upper and lower slides being relatively shiftable, placing a high density indicator on one of the upper and lower slides and a low density indicator on the other of the upper and lower slides and a plurality of tone reference number curves on one of the upper and lower slides and a tone intersect line on the other of the upper and lower slides, shiftably mounting a transparent cursor on the base, overlying the upper and lower slides and shiftable with respect thereto and having a half tone placement indicator thereon, arranging the base, lower slide, upper slide and cursor to be sequentially shiftable with respect to one another, determining a predetermined high density reading and a predetermined low density reading and shifting the upper and lower slides to produce alignment of the high density indicator and the low density indicator in accordance with the respective predetermined high and low density readings on the original density scale thereby causing the tone intersect line to intersect the tone reference number curves, and shifting of the cursor to a chosen point of intersection of the tone intersect line with a tone reference curve to bring the half tone placement indicator into alignment with a reading on the density compression scale to indicate a density for optimum half tone density position on the stand-in gray scale.

10. The invention in accordance with claim 9 wherein the guideway is formed with two opposing longitudinal spaced edges with the original density scale positioned along one longitudinal edge of the guideway and the density compression scale positioned along the other longitudinal edge of the guideway.

11. The invention in accordance with claim 9 wherein the lower slide contains the high density indicator and a plurality of tone reference curves and the upper slide contains the low density indicator and the tone intersect line.

12. The invention in accordance with claim 11 wherein the high density indicator and the low density indicator are transverse lines with respect to the longitudinal guideway and the half tone placement indicator is a line transverse to the longitudinal guideway.

13. The invention in accordance with claim 9 wherein the longitudinal guideway is formed by forming a longitudinal rectangular opening in one face of the base and a recess in each of the opposing longitudinal edges of the base adjacent to the longitudinal opening to form a pair of longitudinal recesses in which the upper and lower slides are slidably mounted, the cursor being rectangular in configuration and having a central aperture therethrough in which the base is slidably mounted to permit relative shifting between the cursor and the base.

14. The invention in accordance with claim 13 wherein the base and upper and lower slides are rectangular in configuration.

15. The invention in accordance with claim 9 wherein the calculator is used for determining optimum tone reproduction to maximize color reproduction in a lithographic process.

16. The invention in accordance with claim 9 wherein the density indicated on the density compression scale by the half tone placement indicator is for optimum halftone density position on the gray scale.

* * * * *

UNITED STATES PATENT AND TRADEMARK OFFICE

CERTIFICATE OF CORRECTION

PATENT NO. : 4,390,778

DATED : June 28, 1983

INVENTOR(S) : Thomas N. Toivonen

It is certified that error appears in the above-identified patent and that said Letters Patent are hereby corrected as shown below:

Column 3, line 52, after "arrangement", change "for" to --of--.

Column 9, line 66, after "reproduction", change "ot" to --to--.

Signed and Sealed this

*Eleventh* Day of *October 1983*

[SEAL]

*Attest:*

GERALD J. MOSSINGHOFF

*Attesting Officer*

*Commissioner of Patents and Trademarks*